US009996097B2

(12) United States Patent
Umemoto et al.

(10) Patent No.: US 9,996,097 B2
(45) Date of Patent: Jun. 12, 2018

(54) CONSTANT VOLTAGE GENERATING CIRCUIT

(71) Applicant: ROHM CO., LTD., Kyoto (JP)

(72) Inventors: Kiyotaka Umemoto, Kyoto (JP); Genki Tsuruyama, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days. days.

(21) Appl. No.: 15/012,195

(22) Filed: Feb. 1, 2016

(65) Prior Publication Data

US 2016/0224049 A1 Aug. 4, 2016

(30) Foreign Application Priority Data

Feb. 2, 2015 (JP) ..... 2015-018442

(51) Int. Cl.
*G05F 3/08* (2006.01)
*G05F 3/24* (2006.01)

(52) U.S. Cl.
CPC . *G05F 3/08* (2013.01); *G05F 3/24* (2013.01)

(58) Field of Classification Search
CPC ..... G05F 3/08; G05F 3/24; H03K 19/00
USPC ..... 323/268, 270, 311–314; 327/542, 541, 327/543, 281
See application file for complete search history.

(56) References Cited

U.S. PATENT DOCUMENTS 4,654,578 A * 3/1987 Salerno ..... G05F 3/245 323/313
4,663,584 A * 5/1987 Okada ..... H03H 11/245 323/313
4,970,415 A * 11/1990 Fitzpatrick ..... G05F 3/245 323/313
7,098,729 B2 * 8/2006 Abe ..... G05F 3/30 323/313
7,479,821 B2 * 1/2009 Imura ..... G05F 3/24 257/E27.061
2010/0207686 A1 * 8/2010 Lai ..... G05F 3/30 327/541
2011/0018520 A1 1/2011 Imura
2012/0201065 A1 * 8/2012 Nate ..... H02M 1/4225 363/126
2014/0111182 A1 * 4/2014 Akahori ..... G05F 3/24 323/313

FOREIGN PATENT DOCUMENTS

JP 2011-029912 2/2011

* cited by examiner

*Primary Examiner* — Kyle J Moody
(74) *Attorney, Agent, or Firm* — Fish & Richardson P.C.

(57) ABSTRACT

A constant voltage generating circuit includes an ED-type reference voltage supply that generates a predetermined constant voltage by using a first transistor of depletion-type and a second transistor of enhancement-type that are connected in series between a power supply terminal and a ground terminal, and a third transistor a source of which is connected to an output terminal for the constant voltage, a drain of which is connected to the power supply terminal or the ground terminal, and a gate of which is connected to a connection node between the first transistor and the second transistor.

9 Claims, 10 Drawing Sheets

CONSTANT VOLTAGE GENERATING CIRCUIT

CROSS-REFERENCE TO RELATED APPLICATIONS

This application is based on Japanese Patent Application No. 2015-18442 filed on Feb. 2, 2015, the contents of which are hereby incorporated by reference.

BACKGROUND OF THE INVENTION

1. Field of the Invention

The present invention relates to a constant voltage generating circuit.

2. Description of Related Art

FIG. 10 is a circuit diagram showing an example of conventional constant voltage generating circuits. A constant voltage generating circuit 200 of the present conventional example includes an ED-type reference voltage supply 210 and a buffer amplifier 220. The ED-type reference voltage supply 210 has a simple circuit configuration formed by using a depletion-type N-channel-type metal-oxide-semiconductor field-effect transistor (NMOSFET) 211 and an enhancement-type NMOSFET 212, and generates, with such a simple circuit configuration, a predetermined constant voltage Vreg that is insusceptible to variations in factors such as power supply and temperature.

An example of conventional arts related to this is disclosed in Japanese Patent Application Publication No. 2011-029912.

However, the ED-type reference voltage supply 210 is deficient in current supplying ability, and thus is not able to supply sufficient amount of current to a load 300. As a countermeasure to this problem, it has been a common practice to provide a buffer amplifier 220 having a high current supplying ability on a stage following the ED-type reference voltage supply 210, but this has disadvantageously invited an increase in circuit scale.

SUMMARY OF THE INVENTION

In view of the above problems recognized by the inventors of the present application, it is an object of the present invention to provide a constant voltage generating circuit capable of achieving enhanced current supplying ability without using a buffer amplifier, a power supply device using the same, and an electronic apparatus using the same.

For example, a constant voltage generating circuit disclosed in the present specification includes an ED-type reference voltage supply that generates a predetermined constant voltage by using a first transistor of depletion-type and a second transistor of enhancement-type that are connected in series between a power supply terminal and a ground terminal, and a third transistor a source of which is connected to an output terminal from which the constant voltage is outputted, a drain of which is connected to the power supply terminal or the ground terminal, and a gate of which is connected to a connection node between the first transistor and the second transistor.

Other features, constituent components, operational steps, advantages, and characteristics of the present invention will be further clarified by the following detailed descriptions of best modes and accompanying drawings related thereto.

DETAILED DESCRIPTION OF PREFERRED EMBODIMENTS

Constant Voltage Generating Circuit—First Embodiment

Figure 1:
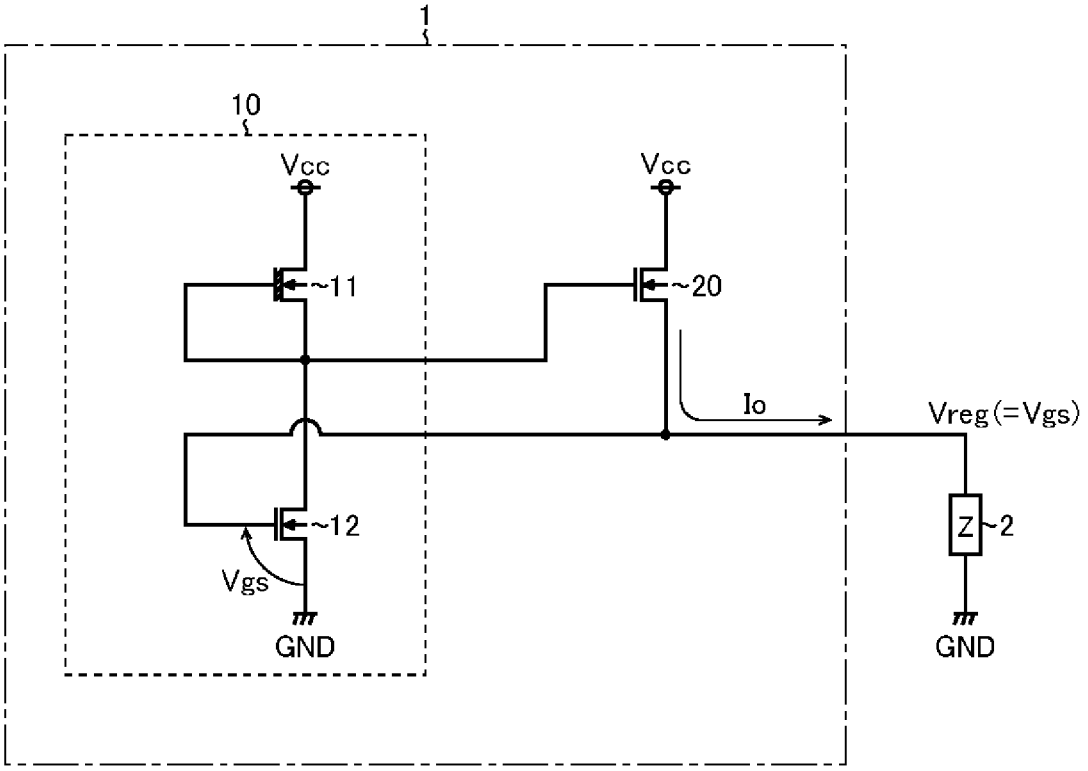
FIG. 1 is a circuit diagram illustrating a first embodiment of a constant voltage generating circuit 1.

FIG. 1 is a circuit diagram illustrating a first embodiment of a constant voltage generating circuit 1. The constant voltage generating circuit 1 of the first embodiment includes an ED-type reference voltage supply 10 and a current supply transistor 20.

The ED-type reference voltage supply 10 generates a predetermined constant voltage Vreg by using a depletion-type NMOSFET 11 (an equivalent of a first transistor) and an enhancement-type NMOSFET 12 (an equivalent of a second transistor) which are connected in series between a power supply terminal (=an application terminal for a power supply voltage Vcc) and a ground terminal (=an application terminal for a ground voltage GND). The depletion-type NMOSFET is one through which current flows even when a gate-source voltage appearing between its gate and source is zero volts. On the other hand, the enhancement-type NMOSFET is one through which current does not flow when the gate-source voltage is zero volts.

Specific connection relationships between elements are as follows. A drain of the NMOSFET 11 is connected to the power supply terminal. A source and a gate of the NMOSFET 11 are both connected to a drain of the NMOSFET 12. A source of the NMOSFET 12 is connected to the ground terminal. A gate of the NMOSFET 12 is connected to an output terminal for the constant voltage Vreg.

In the above-configured ED-type reference voltage supply 10, the NMOSFET 11 functions as a constant current supply that generates a predetermined drive current. The NMOSFET 12 operates by receiving supply of the drive current from the NMOSFET 11, and outputs the predetermined constant voltage Vreg that is insusceptible to variations in factors such as power supply and temperature. Here, the constant voltage Vreg has a value equivalent to a gate-source voltage Vgs of the NMOSFET 12.

The current supply transistor 20 is an NMOSFET (an equivalent of a third transistor) for supplying a desired output current Io to a load 2 connected between the output terminal for the constant voltage Vreg and the ground terminal. Specific connection relationships with respect to the current supply transistor 20 are as follows. A source of the current supply transistor 20 is connected to the output terminal for the constant voltage Vreg. A drain of the current supply transistor 20 is connected to the power supply terminal. A gate of the current supply transistor 20 is connected to a connection node between the NMOSFET 11 and the NMOSFET 12. Here, the current supply transistor 20 may be whichever of an enhancement-type transistor and a depletion-type transistor (in the present figure, an enhancement-type NMOSFET is adopted).

In the constant voltage generating circuit 1 of the first embodiment, the output current Io that flows into the load 2 via the current supply transistor 20 from the power supply terminal varies in accordance with a gate-source voltage of current supply transistor 20. Specifically, the output current Io becomes larger as the gate-source voltage of the current supply transistor 20 becomes higher, and on the other hand, the output current Io becomes smaller as the gate-source voltage of the current supply transistor 20 becomes lower.

Figure 10:
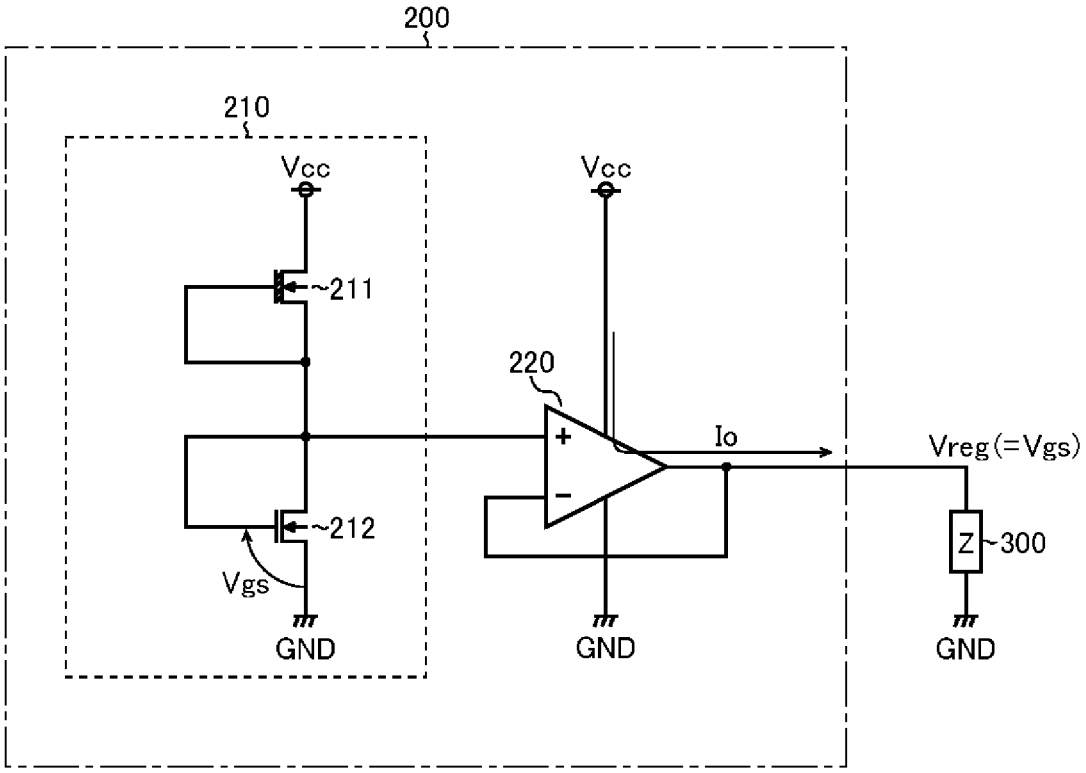
FIG. 10 is a circuit diagram illustrating an example of conventional constant voltage generating circuits.

Here, adopted as the current supply transistor 20 is an element equipped with a greater current supplying ability than the NMOSFET 11 and the NMOSFET 12. Such a configuration does not require provision of a buffer amplifier (see FIG. 10) to enhance the ability of supplying current to the load 2, and thus makes it possible to reduce the circuit scale of the constant voltage generating circuit 1.

Constant Voltage Generating Circuit—Second Embodiment

Figure 2:
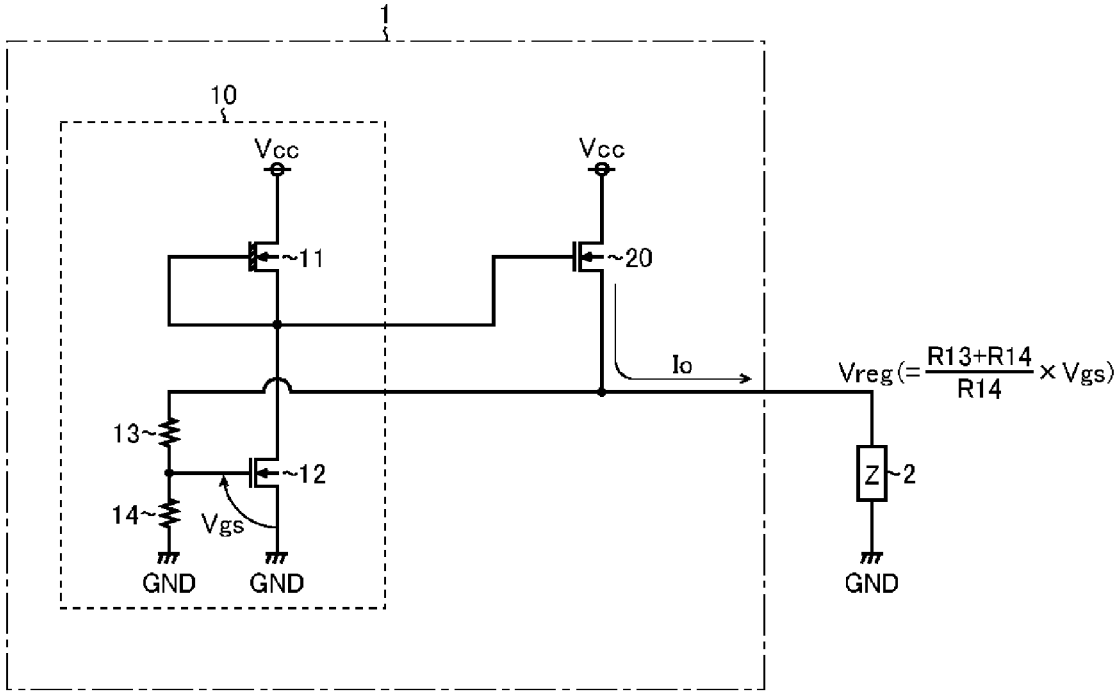
FIG. 2 is a circuit diagram illustrating a second embodiment of the constant voltage generating circuit 1.

FIG. 2 is a circuit diagram illustrating a second embodiment of the constant voltage generating circuit 1. The second embodiment has approximately the same configuration as the above-described first embodiment (FIG. 1), except that resistors 13 and 14 (having resistances R13 and R14, respectively) are added in the second embodiment as components of the ED-type reference voltage supply 10.

Specific connection relationships between elements are as follows. A first terminal of the resistor 13 is connected to the output terminal for the constant voltage Vreg. A second terminal of the resistor 13 and a first terminal of the resistor 14 are both connected to the gate of the NMOSFET 12. A second terminal of the resistor 14 is connected to the ground terminal.

Thus, in the constant voltage generating circuit 1 of the second embodiment, there is connected a voltage divider circuit formed of the resistors 13 and 14 between the output terminal for the constant voltage Vreg and the gate of the NMOSFET 12. Thus, the constant voltage Vreg has a voltage value ($=\alpha\times Vgs$) obtained by multiplying the gate-source voltage Vgs of the NMOSFET 12 by a predetermined gain $\alpha$ ($=(R13+R14)/R14$). That is, the constant voltage generating circuit 1 of the second embodiment makes it possible to obtain the constant voltage Vreg (>Vgs) that is higher than is obtained with the constant voltage generation circuit 1 of the previously-described first embodiment.

Constant Voltage Generating Circuit—Third Embodiment

Figure 3:
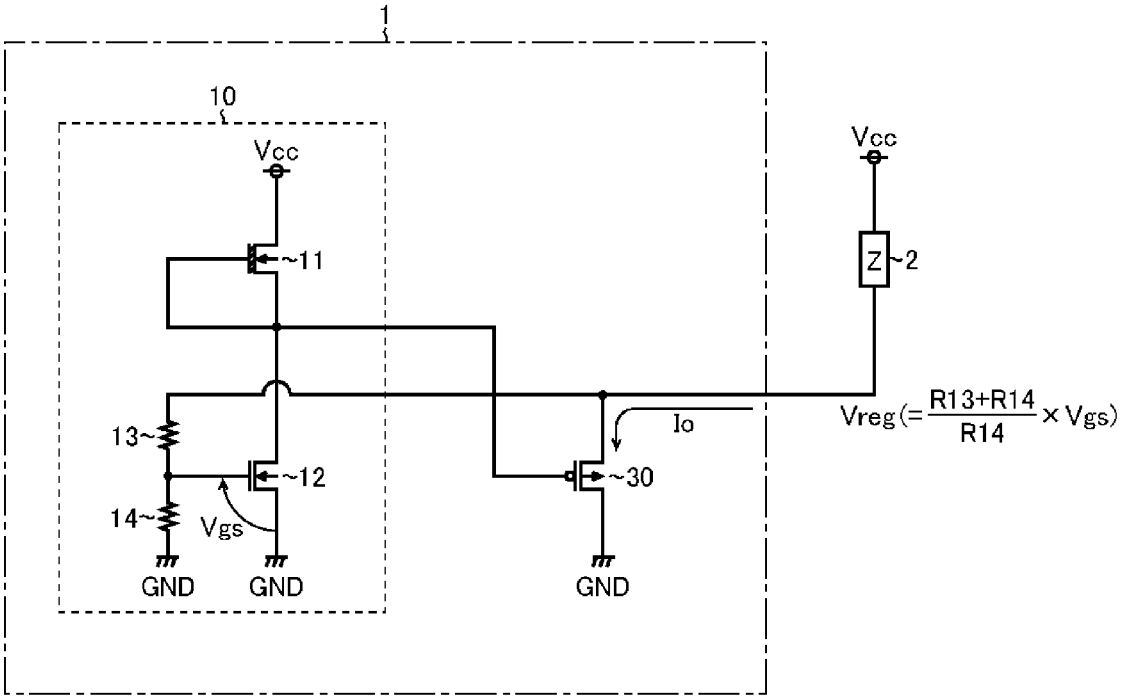
FIG. 3 is a circuit diagram illustrating a third embodiment of the constant voltage generating circuit 1.

FIG. 3 is a circuit diagram illustrating a third embodiment of the constant voltage generating circuit 1. The third embodiment has approximately the same configuration as the above-described second embodiment (FIG. 2), except that the third embodiment adopts a current supply transistor 30 that is a P-channel type MOSFET (PMOSFET), instead of the current supply transistor 20 that is an NMOSFET.

The current supply transistor 30 is a PMOSFET for supplying the desired output current Io to the load 2 connected between the power supply terminal and the output terminal for the constant voltage Vreg. Specific connection relationships with respect to the current supply transistor 30 are as follows. A source of the current supply transistor 30 is connected to the constant voltage Vreg output terminal. A drain of the current supply transistor 30 is connected to the ground terminal. A gate of the current supply transistor 30 is connected to a connection node between the NMOSFET 11 and the NMOSFET 12. Here, the current supply transistor 30 may be whichever of an enhancement-type transistor and a depletion-type transistor (in the present figure, an enhancement-type PMOSFET is adopted).

Unlike the constant voltage generating circuits 1 of the previously-described first and second embodiments (FIG. 1 and FIG. 2), the constant voltage generating circuit 1 of the third embodiment makes it possible to draw the output current Io from the load 2 toward the ground terminal, instead of making the output current Io flow from the power supply terminal toward the load 2. Thus, in a case where the load 2 is connected between the power supply terminal and the output terminal for the constant voltage Vreg, adoption of the configuration of the third embodiment makes it possible to enjoy the same merits as are enjoyed with the previously-described first and second embodiments (FIG. 1 and FIG. 2).

Constant Voltage Generating Circuit—Fourth Embodiment

Figure 4:
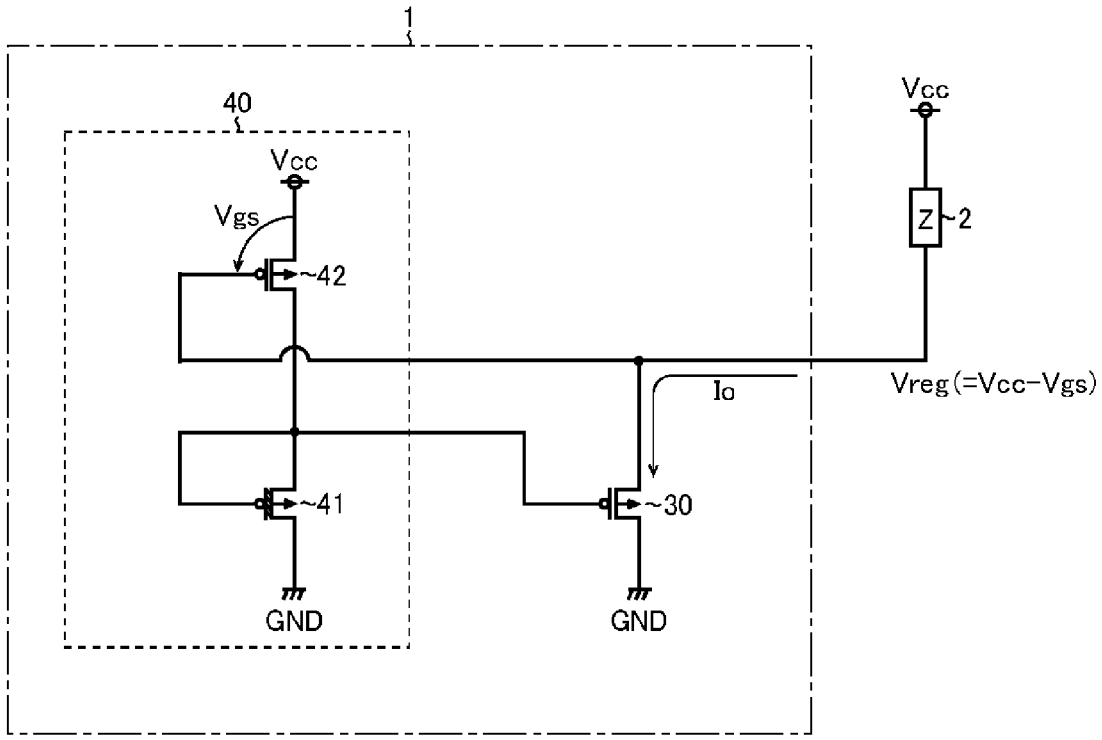
FIG. 4 is a circuit diagram illustrating a fourth embodiment of the constant voltage generating circuit 1.

FIG. 4 is a circuit diagram illustrating a fourth embodiment of the constant voltage generating circuit 1. The fourth embodiment has approximately the same configuration as the above-described third embodiment (FIG. 3), except that the fourth embodiment adopts an ED-type reference voltage supply 40 using a depletion-type PMOSFET 41 (an equivalent of the first transistor) and an enhancement-type PMOSFET 42 (an equivalent of the second transistor), instead of the ED-type reference voltage supply 10 using the depletion-type NOSFET 11 and the enhancement-type NMOSFET 12.

Specific connection relationships between elements are as follows. A drain of the PMOSFET 41 is connected to the ground terminal. A source and a gate of the PMOSFET 41 are both connected to a drain of the PMOSFET 42. A source of the PMOSFET 42 is connected to the power supply terminal. A gate of the PMOSFET 42 is connected to the output terminal for the constant voltage Vreg.

In the above-configured ED-type reference voltage supply 40, the PMOSFET 41 functions as the constant current supply that generates the predetermined drive current. The PMOSFET 42 operates by receiving supply of the drive current from the PMOSFET 41, and outputs a predetermined constant voltage Vreg that is insusceptible to variations in factors such as power supply and temperature.

Here, the constant voltage Vreg has a voltage value ($=Vcc-Vgs$) obtained by subtracting a gate-source voltage Vgs of the NMOSFET 42 from the power supply voltage Vcc. Thus, unlike the constant voltage generating circuits 1 of the previously-described first to third embodiments, the constant voltage generating circuit 1 of the fourth embodiment makes it possible to generate the constant voltage Vreg with Vcc, not GND, as a reference.

Constant Voltage Generating Circuit—Fifth Embodiment

Figure 5:
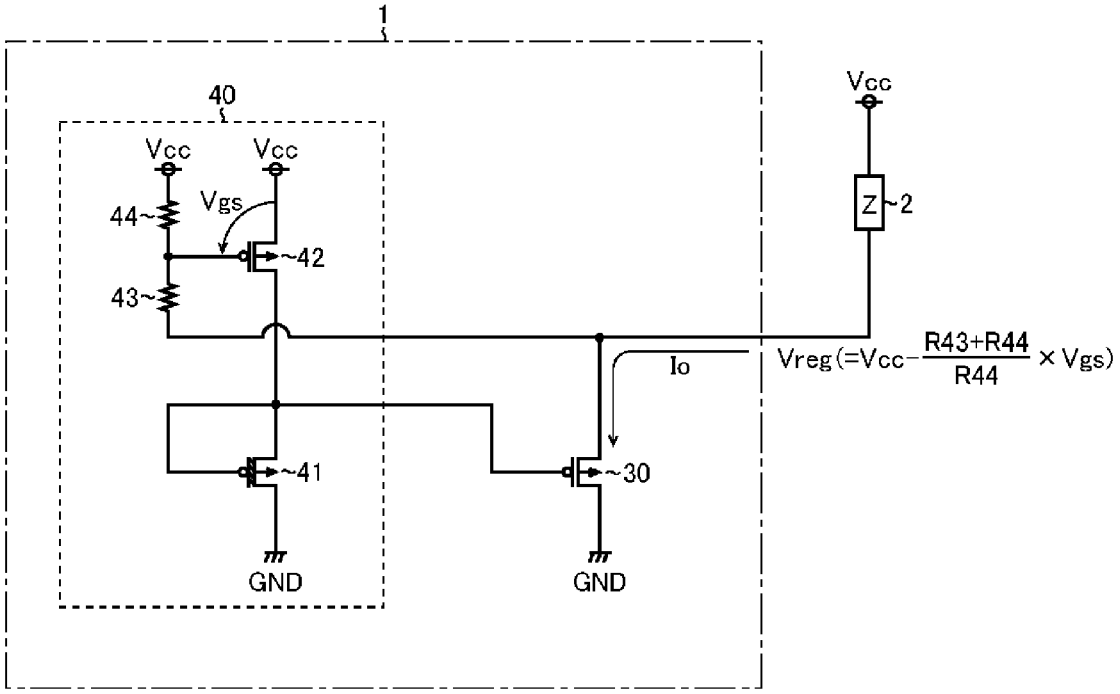
FIG. 5 is a circuit diagram illustrating a fifth embodiment of the constant voltage generating circuit 1.

FIG. 5 is a circuit diagram illustrating a fifth embodiment of the constant voltage generating circuit 1. The fifth embodiment has approximately the same configuration as the above-described fourth embodiment (FIG. 4), except that resistors 43 and 44 (having resistances R43 and R44, respectively) are added in the fifth embodiment as components of the ED-type reference voltage supply 10.

Specific connection relationships between elements are as follows. A first terminal of the resistor 43 is connected to the output terminal for the constant voltage Vreg. A second terminal of the resistor 43 and a first terminal of the resistor 44 are both connected to the gate of the PMOSFET 42. A second terminal of the resistor 44 is connected to the power supply terminal.

Thus, in the constant voltage generating circuit 1 of the fifth embodiment, there is connected a voltage divider circuit formed of the resistors 43 and 44 between the output terminal for the constant voltage Vreg and the gate of the PMOSFET 42. Thus, the constant voltage Vreg has a voltage value ($=Vcc-\beta\times Vgs$) obtained by subtracting, from the power supply voltage Vcc, a voltage obtained by multiplying the gate-source voltage Vgs of the PMOSFET 42 by a predetermined gain $\beta$ ($=(R43+R44)/R44$). That is, the constant voltage generating circuit 1 of the fifth embodiment makes it possible to obtain the constant voltage Vreg ($<Vcc-Vgs$) that is lower than the constant voltage Vreg obtained with the constant voltage generation circuit 1 of the previously-described fourth embodiment.

Constant Voltage Generating Circuit—Sixth Embodiment

Figure 6:
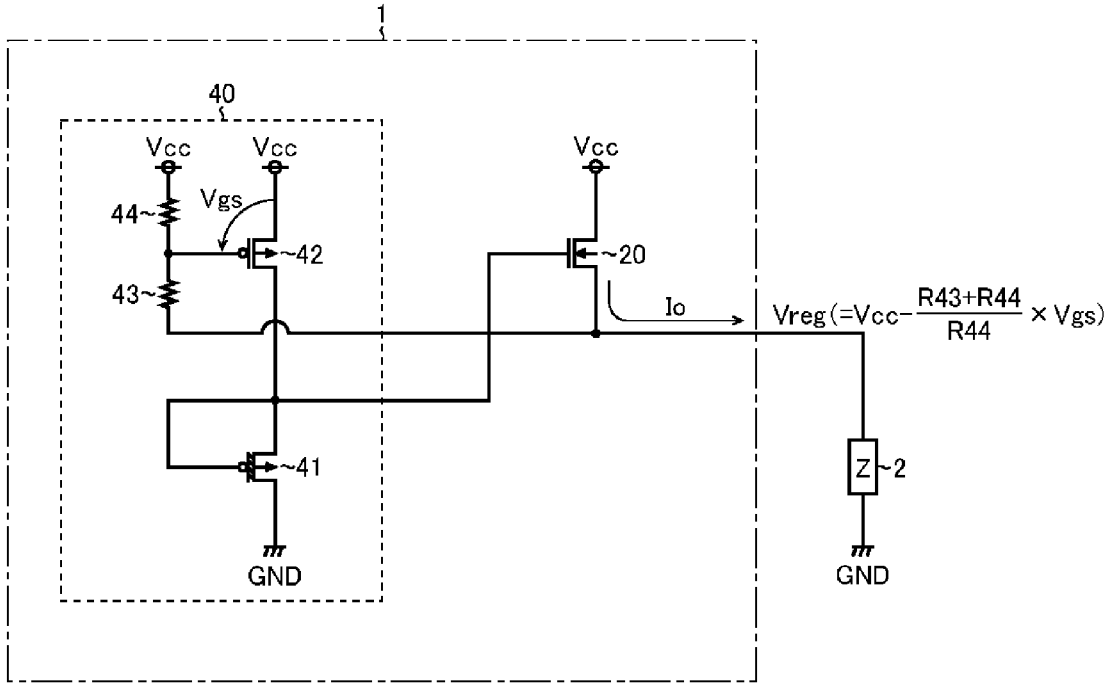
FIG. 6 is a circuit diagram illustrating a sixth embodiment of the constant voltage generating circuit 1.

FIG. 6 is a circuit diagram illustrating a sixth embodiment of the constant voltage generating circuit 1. The sixth embodiment has approximately the same configuration as the above-described fifth embodiment (FIG. 5), except that the sixth embodiment adopts the NMOSFET current supply transistor 20 instead of the PMOSFET current supply transistor 30.

As in the previously-described first and second embodiments (FIG. 1 and FIG. 2), the current supply transistor 20 is an NMOSFET for supplying the desired output current Io to the load 2 connected between the power supply terminal and the constant voltage Vreg output terminal. Specific connection relationships with respect to the current supply transistor 20 are as follows. The source of the current supply transistor 20 is connected to the output terminal for the constant voltage Vreg. The drain of the current supply transistor 20 is connected to the power supply terminal. The gate of the current supply transistor 20 is connected to a connection node between the PMOSFET 41 and the PMOSFET 42. Here, the current supply transistor 20 may be whichever of an enhancement-type transistor and a depletion-type transistor (in the present figure, an enhancement-type NMOSFET is adopted).

Unlike the constant voltage generating circuits 1 of the previously-described fourth and fifth embodiments (FIG. 4 and FIG. 5), the constant voltage generating circuit 1 of the sixth embodiment makes it possible to make the output current Io flow from the power supply terminal to the load 2, instead of drawing the output current Io from the load 2 toward the ground terminal. Thus, in a case where the load 2 is connected between the output terminal for the constant voltage Vreg and the ground terminal, adoption of the configuration of the sixth embodiment makes it possible to enjoy the same merits as are enjoyed with the previously-described fourth and fifth embodiments (FIG. 4 and FIG. 5).

Figure 7:
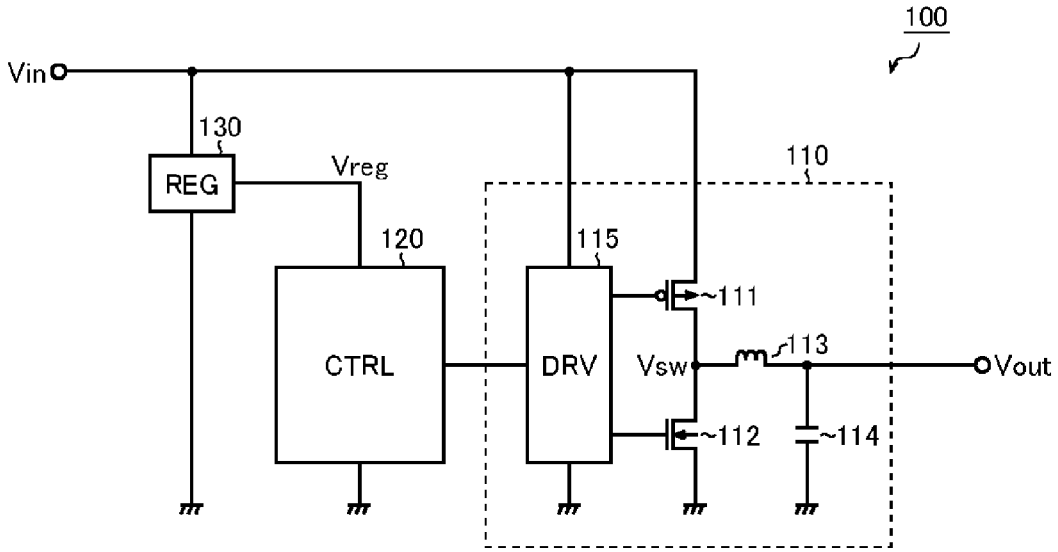
FIG. 7 is a block diagram illustrating an example of a configuration of a power supply device 100.

Power Supply Device:

FIG. 7 is a block diagram illustrating an example of a configuration of a power supply device 100. The power supply device 100 having the configuration of the present example has an output circuit 110, a control circuit 120, and a constant voltage generating circuit 130.

The output circuit 110 is a step-down switching output stage that generates an output voltage Vout by stepping down an input voltage Vin, the output circuit 110 including an output transistor (PMOSFET) 111, a synchronous rectifying transistor (NMOSFET) 112, an inductor 113, a capacitor 114, and a driver 115.

A source of the output transistor 111 is connected to an input terminal for an input voltage Vin. Drains of the output transistor 111 and the synchronous rectifying transistor 112 are both connected to a first terminal of the inductor 113. A source of the synchronous rectifying transistor 112 is connected to the ground terminal. Gates of the output transistor 111 and the synchronous rectifying transistor 112 are each connected to the driver 115. A second terminal of the inductor 113 and a first terminal of the capacitor 114 are both connected to an output terminal for the output voltage Vout. A second terminal of the capacitor 114 is connected to the ground terminal.

The output transistor 111 and the synchronous rectifying transistor 112 are switching devices complementarily driven by the driver 115. As used herein, the term "complementarily" includes not only a case where on/off states of the output transistor 111 and the synchronous rectifying transistor 112 are completely reversed, but also a case where a simultaneous off period (what is called a dead time) of the transistors is provided in order to prevent a through current.

The inductor 113 and the capacitor 114 function as a rectifying and smoothing circuit that generates the output voltage Vout by rectifying and smoothing a rectangular wave-shaped switch voltage Vsw that appears at a connection node between the output transistor 111 and the synchronous rectifying transistor 112.

The driver 115 operates by receiving supply of the input voltage Vin, and generates gate signals of the output transistor 111 and the synchronous rectifying transistor 112 as instructed by the control circuit 120.

Here, although the present figure illustrates an example where a PMOSFET is used as the output transistor 111 and an NMOSFET is used as the synchronous rectifying transistor 112, but an NMOSFET may be used as the output transistor 111, or a rectifying diode may be used instead of the synchronous rectifying transistor 112. Further, an output form of the output circuit 110 is not limited to this, and a step-up, step-up and -down, or polarity-reversing switching output stage may be adopted, or a linear output stage may be adopted instead of the switching output stage.

The control circuit 120 operates by receiving supply of the constant voltage Vreg, and performs output feedback control on the output circuit 110 such that the output voltage Vout has a desired value. Known methods such as the pulse width modulation (PWM) method and the pulse frequency modulation (PFM) method may be applied to the output feedback method, and thus the output feedback method will not be described in detail.

The constant voltage generating circuit 130 is a circuit that supplies the constant voltage Vreg to the control circuit 120. Application of any of the previously-described constant voltage generating circuits 1 as the constant voltage generating circuit 130 makes it possible to reduce the circuit scale of the power supply device 1.

Figure 8:
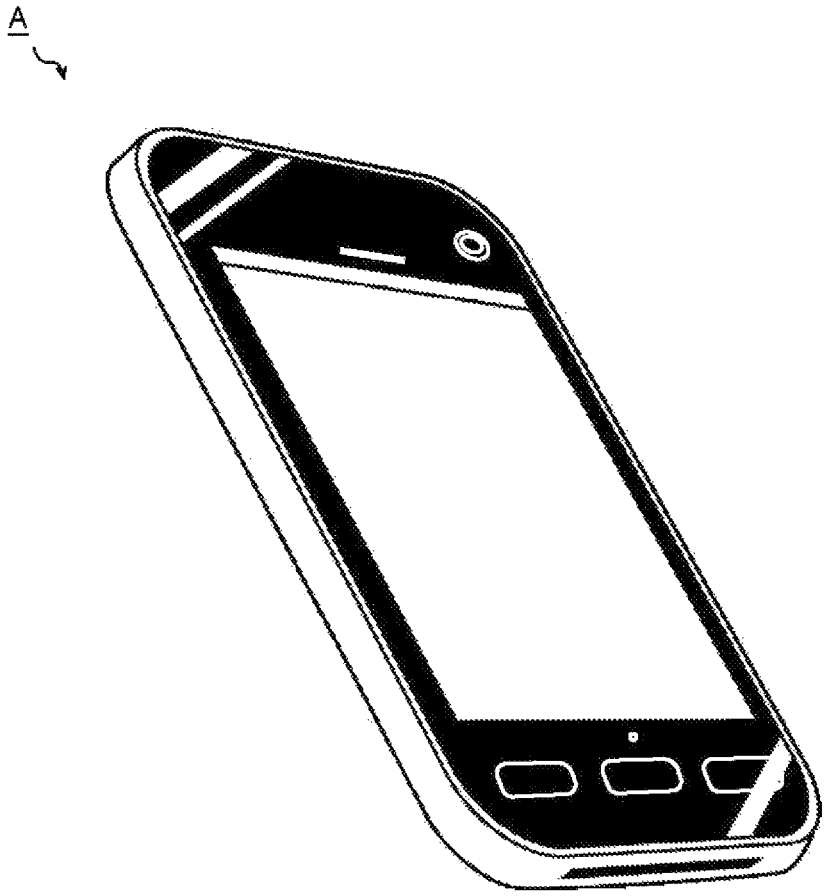
FIG. 8 is an external view of a smart phone A.
Figure 9:
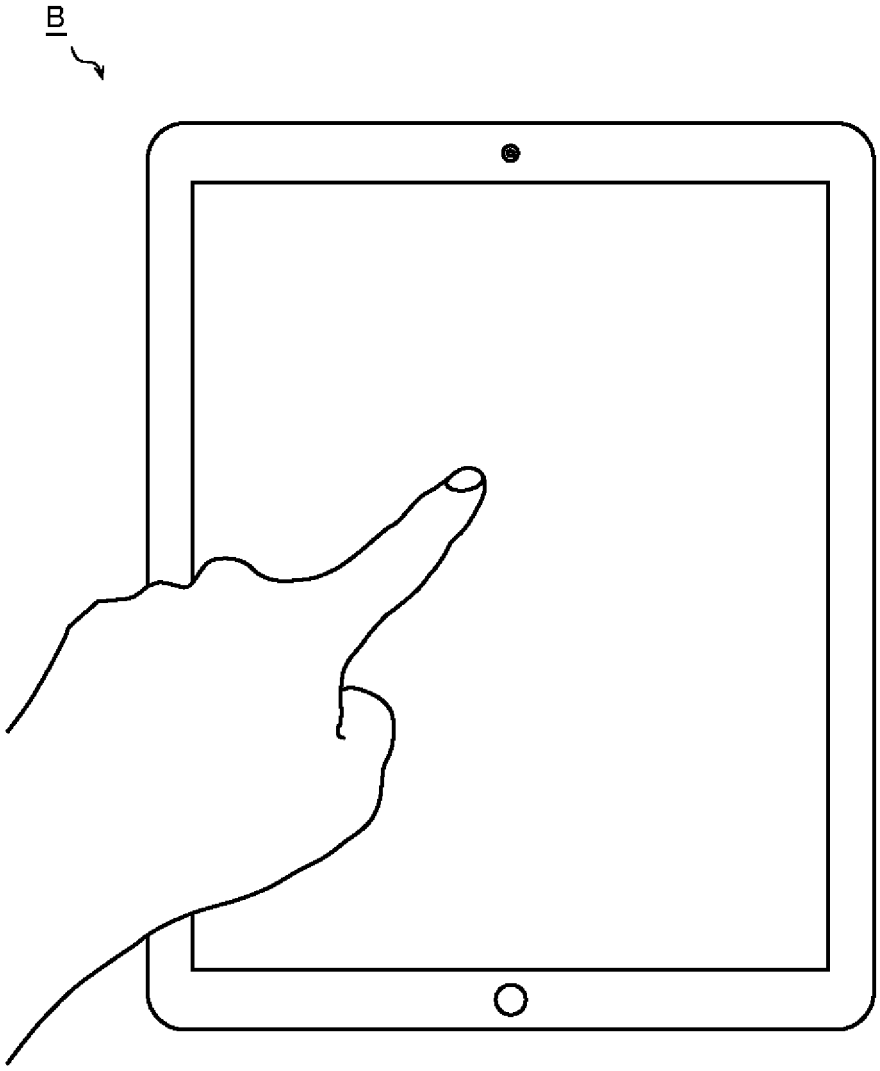
FIG. 9 is an external view of a tablet personal computer B.

Electronic Apparatus:

FIG. 8 is an external view of a smart phone A and FIG. 9 is an external view of a tablet personal computer 13. The smart phone A and the tablet personal computer B are each a specific example of an electronic apparatus in which the previously-described power supply device 100 is mounted. It should be understood, however, mounting targets in which to mount the power supply device 100 are not limited to these at all, and the power supply device 100 is widely applicable to any electronic apparatuses (such as notebook personal computers and portable game machines) where compactness and handiness are required.

Other Modified Examples

In addition to the above embodiments, it is possible to add various modifications to the various technical features disclosed herein without departing the spirit of the technological creation. In other words, it should be understood that the above embodiments are examples in all respects and are not limiting; the technological scope of the present invention is not indicated by the above description of the embodiments but by the claims; and all modifications within the scope of the claims and the meaning equivalent to the claims are covered.

INDUSTRIAL APPLICABILITY

The constant voltage generating circuits disclosed herein are usable as, for example, an internal power supply for an electronic apparatus.

What is claimed is:

1. A constant voltage generating circuit comprising:

an enhancement-depletion-type (ED-type) reference voltage supply operable to generate a predetermined constant voltage by using a first transistor of depletion-type and a second transistor of enhancement-type that are connected in series between a power supply terminal and a ground terminal; and a third transistor of enhancement-type, a source of which is directly connected to an output terminal for the predetermined constant voltage, a drain of which is connected to the power supply terminal or the ground terminal, and a gate of which is connected to a connection node between the first transistor and the second transistor, wherein the third transistor is equipped with a greater current supplying ability than the first transistor and the second transistor, wherein the first transistor and the second transistor are N-channel type transistors, and wherein the first transistor has a drain thereof connected to the power supply terminal and a source and a gate thereof connected to a drain of the second transistor, and the second transistor has a source thereof connected to the ground terminal and a gate thereof directly connected to the output terminal for the predetermined constant voltage.

2. The constant voltage generating circuit according to claim 1, wherein the ED-type reference voltage supply further includes:

a first resistor connected between the output terminal for the predetermined constant voltage and the gate of the second transistor; and a second resistor connected between the ground terminal and the gate of the second transistor.

3. A power supply device comprising:

an output circuit that generates an output voltage from an input voltage;

a control circuit that controls the output circuit such that the output voltage has a desired value; and the constant voltage generating circuit according to claim 1 that supplies the predetermined constant voltage to the control circuit.

4. An electronic apparatus comprising the power supply device according to claim 3.

5. A constant voltage generating circuit comprising:

an enhancement-depletion-type (ED-type) reference voltage supply operable to generate a predetermined constant voltage by using a first transistor of depletion-type and a second transistor of enhancement-type that are connected in series between a power supply terminal and a ground terminal; and a third transistor of enhancement-type, a source of which is directly connected to an output terminal for the predetermined constant voltage, a drain of which is connected to the power supply terminal or the ground terminal, and a gate of which is connected to a connection node between the first transistor and the second transistor, wherein the third transistor is equipped with a greater current supplying ability than the first transistor and the second transistor, wherein the first transistor and the second transistor are P-channel type transistors, and wherein the first transistor has a drain thereof connected to the ground terminal and a source and a gate thereof connected to a drain of the second transistor, and the second transistor has a source thereof connected to the power supply terminal and a gate thereof directly connected to the output terminal for the predetermined constant voltage.

6. The constant voltage generating circuit according to claim 5, wherein the ED-type reference voltage supply further includes:

a first resistor connected between the output terminal for the predetermined constant voltage and the gate of the second transistor; and a second resistor connected between the power supply terminal and the gate of the second transistor.

7. A power supply device comprising:

an output circuit that generates an output voltage from an input voltage;

a control circuit that controls the output circuit such that the output voltage has a desired value; and the constant voltage generating circuit according to claim 5 that supplies the predetermined constant voltage to the control circuit.

8. An electronic apparatus comprising the power supply device according to claim 7.

9. A constant voltage generating circuit comprising:

an enhancement-depletion-type (ED-type) reference voltage supply operable to generate a predetermined constant voltage by using a first transistor of depletion-type and a second transistor of enhancement-type that are connected in series between a power supply terminal and a ground terminal; and a third transistor, a source of which is connected to an output terminal for the predetermined constant voltage, a drain of which is connected to the power supply terminal or the ground terminal, and a gate of which is connected to a connection node between the first transistor and the second transistor, wherein the first transistor and the second transistor are P-channel type transistors, wherein the first transistor has a drain thereof connected to the ground terminal and a source and a gate thereof connected to a drain of the second transistor, and the second transistor has a source thereof connected to the power supply terminal and a gate thereof connected to the output terminal for the predetermined constant voltage, and wherein the ED-type reference voltage supply further includes:

a first resistor connected between the output terminal for the predetermined constant voltage and the gate of the second transistor; and a second resistor connected between the power supply terminal and the gate of the second transistor.

* * * * *